United States Patent [19]

Gray et al.

[11] Patent Number: 4,925,687

[45] Date of Patent: May 15, 1990

[54] TURKEY PACKAGE

[75] Inventors: Stephen L. Gray, Moore; John E. Horner, Taylors, both of S.C.

[73] Assignee: W. R. Grace & Co.-Conn., Duncan, S.C.

[21] Appl. No.: 229,593

[22] Filed: Aug. 8, 1988

[51] Int. Cl.[5] ..... B65B 31/02

[52] U.S. Cl. ..... 426/129; 426/393; 426/410; 426/513; 426/644; 426/646; 53/432

[58] Field of Search ..... 426/129, 383, 410, 412, 426/413, 414, 513, 644, 646; 53/432

[56] References Cited

U.S. PATENT DOCUMENTS

| | | | |
|---|---|---|---|
| 2,640,779 | 6/1953 | George | 426/644 |
| 3,563,764 | 2/1971 | Posegate | 99/107 |
| 3,673,041 | 6/1972 | Schulz | 156/306 |
| 3,703,064 | 11/1972 | Lugiewicz | 53/122 |
| 3,740,921 | 6/1973 | Meyer | 53/112 |
| 3,760,556 | 9/1973 | Morris | 53/122 |
| 3,853,999 | 12/1974 | Kentor | 426/105 |
| 3,928,938 | 12/1974 | Burrell | 53/22 |
| 3,950,919 | 4/1976 | Perdue | 53/22 |
| 4,132,048 | 1/1979 | Day | 53/434 |
| 4,251,976 | 2/1981 | Zanni | 53/433 |
| 4,411,919 | 10/1983 | Thompson | 426/412 |
| 4,586,320 | 5/1986 | Takai | 53/512 |
| 4,606,922 | 8/1986 | Schirmer | 426/412 |
| 4,672,793 | 6/1987 | Terlizzi, Jr. et al. | 53/434 |

FOREIGN PATENT DOCUMENTS

| | | |
|---|---|---|
| 269325 | 6/1988 | European Pat. Off. . |
| 1516498 | 7/1978 | United Kingdom . |

*Primary Examiner*—Donald E. Czaja
*Assistant Examiner*—Evan Federman
*Attorney, Agent, or Firm*—John J. Toney; William D. Lee; Jennifer L. Skord

[57] ABSTRACT

A method of packaging turkey emulsion and turkey skin in a flexible plastic package wherein the turkey skin has been frozen prior to insertion into the package.

2 Claims, 3 Drawing Sheets

TURKEY PACKAGE

FIELD OF THE INVENTION

The invention disclosed herein relates to the packaging of turkey and more particularly to vacuum packaging of discrete pieces of turkey meat adjacent frozen turkey skin in a thermoplastic flexible bag. At this point the package may be frozen or refrigerated for storage. Typically, the bag material is oriented, i.e. heat-shrinkable, as the resultant packaged product is often intended for cook-in, during which the material shrinks about the product for a tight fit. The bag of cooked turkey is then sold in the retail stores.

BACKGROUND OF THE INVENTION

When discrete pieces of turkey, such as comminuted turkey meat or turkey emulsion, are packaged, it is aesthetically appealing for the turkey to be packaged with a section of turkey skin, as the skin makes the resultant packaged article look more like a whole turkey. Problems have occurred in the past with packaging because when skin is room temperature or refrigerated, it is limp or flimsy in nature. Aligning the limp skin in a bag was difficult, since the limp skin could not stand alone in a bag. One answer was to have the bag disposed horizontally with the skin horizontally disposed therein on the bag bottom panel, but then filling the bag horizontally with emulsion presented the drawback of bag neck area contamination, as compared to vertical filling. Thus, to achieve vertical filing, the skin was draped around the stuffing horn nozzle of a vacuum packaging apparatus. A bag was then vertically placed around the skin and then turkey emulsion was injected into the bag. But as a result of this contact with the horn, there was the drawback of a contamination of liquid, fat, or pieces of turkey at the bag mouth end, i.e. bag neck area. This is the area that is clipped or heat sealed closed after the bag is filled with turkey, so the contamination interfered with bag closure. In fact, one patent mentioned below, U.S. Pat. No. 3,673,041, is directed to a special heat seal bar for squeezing contaminants such as liquids or fatty substances out of the sealing area before the sheets of plastic fuse together and in those cases where solid particulate contaminants are found in the sealing area utilizing steam flushing to clean the surfaces prior to sealing. Also, regardless of horizontal or vertical packaging, the resultant packaged skin often looked wrinkled.

Many apparatus for vacuum stuffing or packaging are well known. One is the Belam vacuum meat press marketed by Belam, Inc., Oak Brook, Ill. Many patents disclose such apparatus, for example U.S. Pat. Nos. 3,563,764, 3,703,064, 3,760,556, 3,853,999, 3,928,938, 3,950,919, 4,132,048, 4,251,976, 4,586,320 and 4,672,793 and UK Published Patent Specification No. 1,516,498, the disclosures of all of which are incorporated herein by reference.

Also, some patents are specific to the bag closure means of the vacuum packaging apparatus, the closure being accomplished by heat sealing with a heat seal bar such as that described in U.S. Pat. No. 3,673,041 or being accomplished by clipping the bag neck with a clipper apparatus such as that described in U.S. Pat. No. 3,740,921. The disclosures of these two patents are incorporated herein by reference.

The Package of turkey can be frozen or refrigerated for storage. Either before or after storage, the turkey package can be subjected to cook-in. For turkey, cook-in is a long slow process, typically about 1 to 4 hours, and can be up to 12 hours, at a temperature typically of about 160° F. (71° C.) to 200° F. (93° C.) and can be from about 131° F. (55° C.) to 212° F. (100° C.). Cook-in films are described in U.S. Pat. Nos. 4,411,919, 4,606,922, and 4,469,742 and commonly assigned published European Patent Application No. 269325, publication date of June 1, 1988 (counterpart of commonly assigned copending U.S. Ser. No. 932,138 filed. Nov. 17, 1986), the disclosures of all of which are incorporated herein by reference. If the turkey has been packaged in a bag of heatshrinkable film (i.e. oriented film, which is further discussed below), then during cook-in the heat-shrinkable bag will shrink about the turkey to form a tightly fitting package. For certain cook-in applications, such as oven roast, the bags are perforated, for instance with round perforations from needles or with oblong perforations from pointed-end knife blades. A perforating apparatus is described in U.S. Pat. No. 3,038,198, the disclosure of which is incorporated herein by reference. Oblong perforations are disclosed in Australian Published Patent Application No. 62078/86, published Apr. 9, 1987, corresponding to U.S. Ser. No. 785,419, the disclosure of which is incorporated herein by reference.

STATEMENT OF INVENTION

It is an object of the present invention to provide an improved method for the packaging of turkey with turkey skin, wherein the skin has been frozen prior to packaging. It is another object of the invention to facilitate vertical packaging of turkey with turkey skin. It is a feature of the present invention that alignment of the turkey skin in a bag is facilitated whereby bag neck area contamination is avoided. It is an advantage of the invention that wrinkling of the skin is avoided; the packaged turkey skin is substantially wrinkle free.

Therefore, the present invention provides a method to package discrete pieces of turkey meat together with turkey skin, said method comprising:

(a) providing a bag comprising a flexible thermoplastic container having an open neck end and opposing bag panels;

(b) inserting into the bag through the open neck end a section of turkey skin, said turkey skin section having been frozen, the turkey skin section being aligned against one bag panel;

(c) extruding via a vacuum stuffing apparatus turkey meat pieces under pressure against the turkey skin section opposite bag panel;

(d) vacuumizing the bag of turkey meat pieces and turkey skin section; and (e) closing the open neck end of the bag.

DETAILED DESCRIPTION

Figure 1:
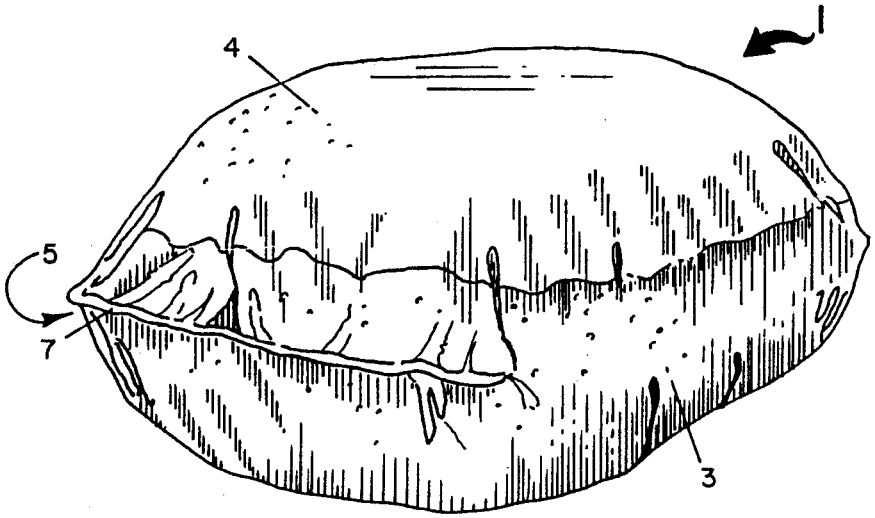
FIG. 1 is a perspective view of a turkey package according to the invention.

Thermoplastic flexible films may be generally manufactured by extrusion (single layer films) or coextrusion (multi-layer films) of thermoplastic resinous materials heated to or above their flow or melting point from an extrusion or coextrusion die in, for example, either tubular or planar (sheet) form, followed by a post extrusion cooling. If heat-shrinkable film is desired, stretching may be conducted at some point during the cool down and while the film is still hot and within its orientation temperature range followed by completing the cooling. Alternatively, after the post extrusion cooling, the relatively thick "tape" extrudate is then reheated to a temperature within its orientation temperature range and stretched to orient the material and then cooled. This is colloquially referred to as the "double bubble" technique, and is described in U.S. Pat. No. 3,456,044 (July 15, 1969) and U.S. Pat. No. 3,555,604 (Jan. 19, 1971), both to Pahlke. When the stretching force is applied in one direction monoaxial orientation results, and when simultaneously applied in two directions biaxial orientation results. The term oriented is also herein used interchangeably with the term "heat-shrinkable" with these terms designating a material which has been stretched and set by cooling while substantially retaining its stretched dimensions. An oriented (i.e. heat-shrinkable) material will tend to return to its original unstretched (unextended) dimensions when heated to an appropriate elevated temperature. An "oriented" or "heat-shrinkable" material is defined herein as a material which, when heated to an appropriate temperature above room temperature (for example 96 C.), will have a free shrink of about 5% or greater in at least one linear direction.

Of course, if a film having a little or no orientation is desired, e.g. non-oriented or non-heat shrinkable film, the film may be formed from a nonorientable material or, if formed form an orientable material may be formed form a tube by using a "trapped bubble" technique commonly known as the "hot blown" technique. In forming a hot blown film, the tube is not cooled initially after extrusion or coextrusion but rather is first stretched by a hot blown bubble essentially immediately after extrusion while the tube is still at an elevated temperature above the orientation temperature range of the material. Thereafter, the film is cooled, by well-known methods. Those of skill in the art are well familiar with this process and the fact that the resulting film has substantially unoriented characteristics. Other methods for forming unoriented films are well known. Exemplary, is the method of cast extrusion of cast coextrusion which, likewise, is well known to those in the art.

If the material is of the heat-shrinkable type, then after wrapping, the enclosed product may be subjected to elevated temperatures, for example, by passing the enclosed product through a hot air tunnel or placing the enclosed product in hot water. This causes the enclosing heat shrinkable film to shrink around the product to produce a tight wrapping that closely conforms to the contour of the product. The film sheet or tube may be formed into bags or pouches and thereafter utilized to package a product. In this case, if the film has been formed as a tube it may be preferable first to slit the tubular film to form a film sheet and thereafter form the sheet into bags or pouches. Such bag or pouch forming methods, likewise, are well known to those of skill in the art.

Irradiation of the bag film, if desired, may be accomplished by the use of high energy electrons, ultra violet radiation, X-rays, gamma rays, beta particles etc. Preferably, electrons are employed up to about 20 megarads (Mr) dosage level. The irradiation source can be any electron beam generator operating in a range of about 150 kilovolts to about 6 megavolts with a power output capable of supplying the desired dosage. Many apparatus for irradiating films are known to those of skill in the art. The irradiation is usually carried out at a dosage between about 1 Mr (10 kilogrey) and about 20 Mr (200 kilogrey), with a preferred dosage range of about 2 Mr (20 kilogrey) to about 12 Mr (120 kilogrey). Irradiation can be carried out conveniently at room temperature, although higher and lower temperatures, for example, 0 C. to 60 C. may be employed.

Many polymers are suitable for the bag films. For instance polyolefins such as polyethylene, polypropylene, ethylene/butyl acrylate copolymer, or ethylene/vinyl acetate copolymer may be employed. Also, nylon may be employed. Also blends of these may be employed. Also blends of these may be employed. Also the film may have an oxygen barrier layer such as a layer of polyvinylidene chloride copolymer or ethylene vinyl alcohol copolymer. Typical comonomers for the polyvinylidene chloride copolymer are vinyl chloride or methyl acrylate. Also may be employed (A) a copolymer of (i) a major amount of mol % of an alpha-olefin of the formula $RCH=CH_2$ wherein R is H or $C_1$ to $C_8$ alkyl and (ii) a minor amount by mol % of an alpha, betaethylenically unsaturated carboxylic acid, or (B) a metal salt neutralized ionomer of (A); such materials are commercially available as Primacor or Surlyn, respectively, from du Pont.

DETAILED DESCRIPTION OF THE DRAWINGS

FIG. 1 is a perspective view of a turkey package showing a heat-shrinkable bag 1 that has been packaged with turkey emulsion 3 and frozen turkey skin 4. The package was cooked so that bag 1 is shown here in its shrunk condition forming a tight fit about the emulsion 3 and skin 4. The mouth end 5 of the bag 1 has been heat-sealed closed with mouth end seal 7.

Figure 2:
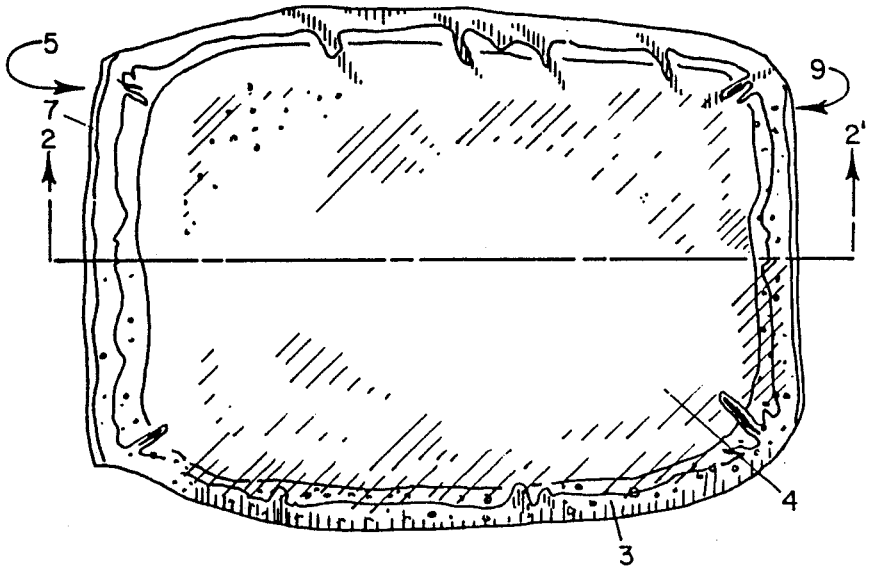
FIG. 2 is a plan view of the turkey package of FIG. 1.

FIG. 2 is a top plan view of the turkey package of FIG. 1. Shown is turkey skin 4 and turkey emulsion 3. The bag is heat-sealed at the end thereof by bottom end seal 9, and the mouth end 5 of the bag has been heat-sealed by mouth end seal 7.

Figure 3:
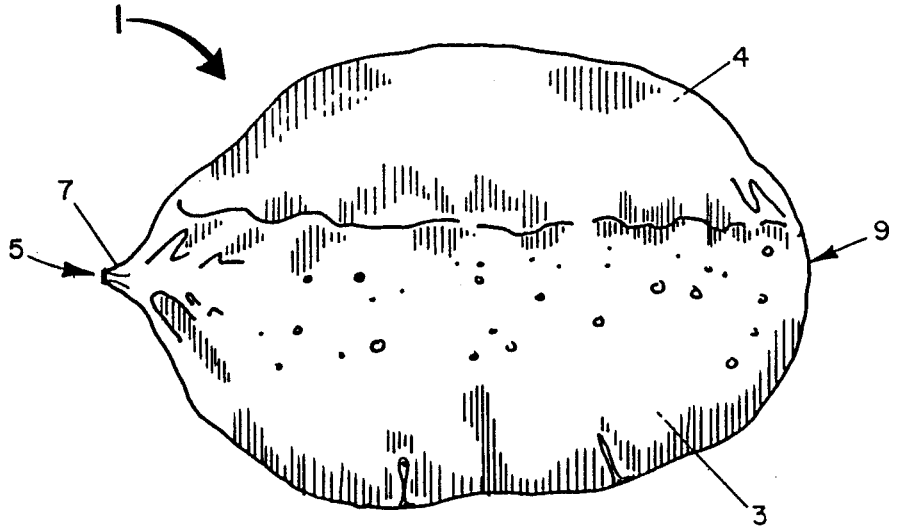
FIG. 3 is a side view of the turkey package of FIG. 1.

FIG. 3 is a side view of the turkey package of FIG. 1. Shown is turkey skin 4 and turkey emulsion 3. The bag 1 has bottom end seal 9, and mouth end 5 heat-sealed by mouth end seal 7.

Figure 4:
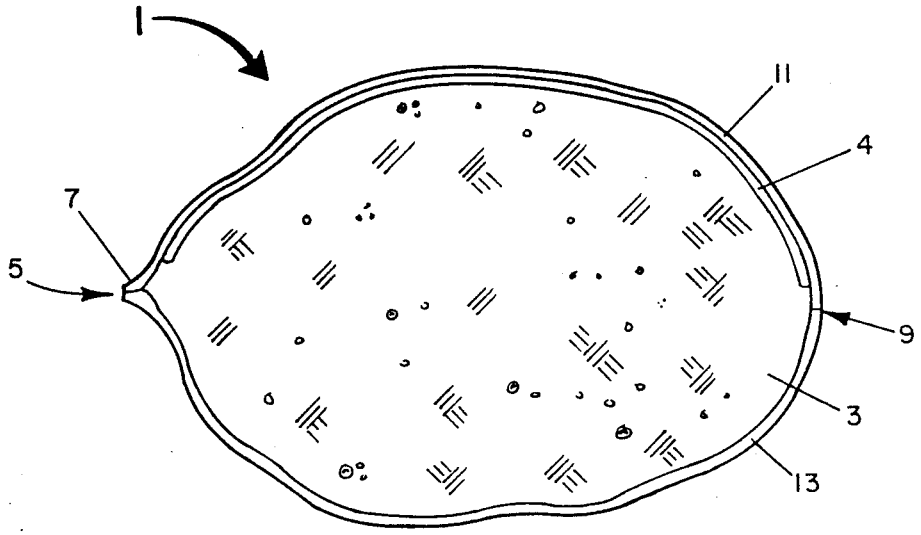
FIG. 4 is a cross-sectional view of the turkey package of FIG. 2 along the plane defined by line 2, 2'.

FIG. 4 is a cross-sectional view of the turkey package of FIG. 2 along the plane defined by 2, 2'. Turkey skin 4 can be seen up adjacent the top panel 11 of the bag 1 and turkey emulsion 3 fills the remainder of the bag from the skin 4 to the bottom panel 13 of the bag. The bag has bottom end seal 9, and mouth end 5 heat-sealed by mouth end seal 7.

Figure 5:
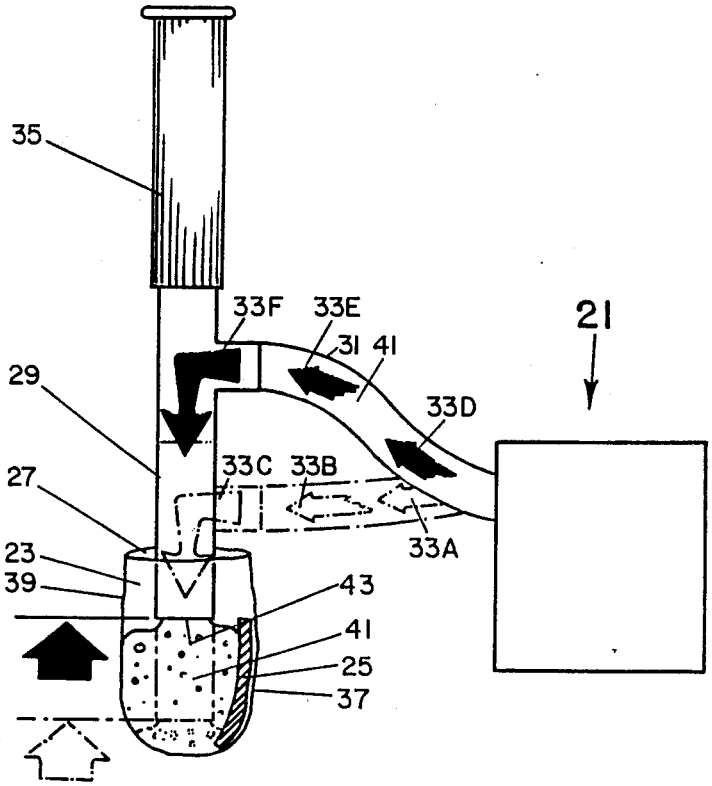
FIG. 5 is a schematic view of a bag containing frozen turkey skin and a vacuum stuffer apparatus.

FIG. 5 is a schematic view of a vacuum stuffer apparatus 21 and a bag 23. The bag may be of heat-shrinkable material or non-heatshrinkable material. Also, the bag material may be mono-layer or multilayer (not illustrated here). Bag 23 is shown vertically disposed with its open mouth end 27 directed upwards and disposed about discharge end 43 of the stuffing horn 29 part of vacuum stuffer apparatus 21. The bag 23 is shown containing a section of frozen turkey skin 25 vertically disposed therein against a bag panel 37. Stuffing horn 29 is shown in its lowered position inside bag 23 between bag panel 39 and frozen skin 25. Via flex hose 31, discrete pieces of turkey meat product 41 are pushed form vacuum stuffer apparatus 21 in the direction of product flow arrows 33A, 33B, 33C, 33D, and 33E into bag 23. Cleanout piston 35 moves up and down to help push the discrete pieces of turkey meat product 41 out of stuffing horn 29 into bag 23. The stuffing horn 29 retracts during the stuffing process (not illustrated here).

In an alternative embodiment not shown in the drawings, the mouth end of the bag could be clipped closed.

The following Examples are intended to illustrate thed preferred embodiments of the invention and comparisons thereto. It is not intended to limit the invention thereby.

MATERIALS EMPLOYED IN THE EXAMPLE

Vestamid L1801 is the trade-name of a nylon 12 type of polyamide, herein abbreviated as PA, supplied by Nuodex.

Surlyn A-1650 is the trade-name of a zinc metal salt neutralized ionomer of ethylene methacrylic acid, herein abbreviated as MSNI, supplied by du Pont.

Bynel E204 is the trade-name of an adhesive supplied by du Pont. It is herein abbreviated as Adh-1.

Bynel 3062 formerly CXA E-162, is the trade-name of an adhesive supplied by du Pont. It is herein abbreviated as Adh-2.

Dowlex XU61512.08 is a linear very low density polyethylene, herein abbreviated as VLDPE, supplied by Dow Chemical. It has octene as the comonomer; the density is 0.905 g/cc; and the melt index is 0.80.

EVAL is the trade-name of an ethylene vinyl alcohol copolymer, herein abbreviated as EVOH. Such materials are also referred to as saponified ethylene/vinyl acetate copolymer. It is supplied by EVAL Company of America.

NPE-4771 is the trade-name of an ethylene/butyl acrylate copolymer, herein abbreviated as EBA. it is supplied by USI. It has about 3% butyl acrylate units by mol %; the melt index is 3.0; and melting point is about 107 to 108 C.

EXAMPLE

All percentages in the film layers were by weight unless indicated otherwise. Co-extruded 6-layer tubular film was made by the double bubble process as described above. Prior to the stretch orientation step, the tube was irradiated at 8 MR (80 Kgrey) +0.5 MR (5 Kgrey). The layers comprised the various polymers as recited below:

| | Sealing Layer 1 | Layer 2 | Layer 3 | Layer 4 | Layer 5 | Abuse Layer 6 |
|---|---|---|---|---|---|---|
| Polymer | 75% PA<br>25% MSNI | 75% Adh-1<br>25% VLDPE | Adh-2 | EVOH | Adh-2 | 60% VLDPE<br>40% EBA |
| Thickness* | | | | | | |
| mils | 2.9 | 4.7 | 1.1 | 1.1 | 1.1 | 5.6 |
| (micrometer) | (74) | (119) | (28) | (28) | (28) | (142) |

*Total thickness of tube wall before orientation was about 16.5 mils (419 micrometer), and after orientation was about 2.2 to 2.5 mils (56 to 64 micrometers).

The oriented tube was then transversely severed and made into bottom end sealed bags about 11 inches (28 cm) wide by 18 inches (46 cm) long, with the sealing layer as the bag inside and the abuse layer as the bag outside.

Raw turkey skins were laid flat and frozen in a standard −40° F. (−40° C.) blast freezer till rigid, the freezing taking about 1 minute or less. The skins were left in the freezer till used. Alternatively, the skins could have been frozen by use of $CO_2$. They had the consistency of leather, i.e. stiff enough to stand up but not brittle, as compared to the flimsiness of room temperature skin. The frozen skins were cut into sections of about 8 inches (20 cm) by 10 inches (25 cm).

Individual sections of frozen skin were inserted through the bag open neck end and placed vertically in individual bags up against one panel of the bag at the inflation station of a Furukawa 8150 vacuum meat stuffing apparatus. The 8150 is described in U.S. Pat. No. 4,586,320, the disclosure of which is incorporated herein by reference. With the bag vertical, the open mouth end of the bag was placed around the discharge end of the horn assembly of the apparatus. Then through the stuffing horn nozzle of the apparatus, raw turkey emulsion was filled into the bag between the section of frozen skin and the other bag panel. The filled bags were vacuumized and then the mouth end heat sealed on the seal bars of the apparatus.

About 2500 pounds (1134 kg) of turkey emulsion was put up in bags with a frozen section of skin. The next day about 2000 pounds (907 kg) was put up with a frozen section of skin.

Product appearance was very impressive, similar to that of whole packaged turkeys. No wrinkles were observed. Seal area contamination was obviated as the frozen skin, unlike ambient or refrigerated skin, did not have to be draped about the nozzle of the horn.

While certain representative embodiments and details have been shown for the purpose of illustration, numerous modifications to the formulations described above can be made without departing from the invention disclosed.

What is claimed is:

1. In a method to package discrete pieces of turkey meat together with a section of turkey skin, said method involving:

(a) providing a bag comprising a flexible thermoplastic container having an open neck end and opposing bag panels wherein the way vertically disposed with the open neck upward;

(b) inserting into the bag through the open neck end a second of turkey skin, the turkey skin section being vertically aligned against one bag panel;

(c) vertically extruding via a vacuum stuffing apparatus turkey meat pieces under pressure against the turkey skin section and opposite bag panel;

(d) vacuumizing the bag of turkey meat pieces and turkey skin section; and (e) closing the open neck end of the bag, the improvement comprising prior to vertically extruding the turkey key meat pieces, inserting into the bag through the open neck end the section of turkey skin, said turkey skin section having been frozen, whereby bag neck area contamination is avoided during extruding.

2. The method of claim 1, wherein the bag is of heat-shrinkable cook-in film.

* * * * *

UNITED STATES PATENT AND TRADEMARK OFFICE

CERTIFICATE OF CORRECTION

PATENT NO. : 4,925,687

DATED : May 15, 1990

INVENTOR(S) : Stephen L. Gray and John E. Horner

It is certified that error appears in the above-identified patent and that said Letters Patent is hereby corrected as shown below:

In col. 6, line 43, change "way" instead to read as --bag is--.

In col. 6, line 45, change "second" instead to read as --section--.

Signed and Sealed this

Seventh Day of May, 1991

*Attest:*

HARRY F. MANBECK, JR.

*Attesting Officer*

*Commissioner of Patents and Trademarks*